US006707482B2

(12) United States Patent
Miyazaki et al.

(10) Patent No.: US 6,707,482 B2
(45) Date of Patent: Mar. 16, 2004

(54) EXPOSURE HEAD AND PRODUCING METHOD FOR A LIGHT GUIDING MEMBER THEREOF

(75) Inventors: Takao Miyazaki, Saitama (JP); Keizo Uchioke, Saitama (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/981,757

(22) Filed: Oct. 19, 2001

(65) Prior Publication Data

US 2002/0047891 A1 Apr. 25, 2002

(30) Foreign Application Priority Data

Oct. 19, 2000 (JP) ..... 2000-319817
Oct. 19, 2000 (JP) ..... 2000-319818

(51) Int. Cl.[7] ..... B41J 27/00
(52) U.S. Cl. ..... 347/241; 347/256
(58) Field of Search ..... 347/241, 243, 347/256, 257, 232; 313/506; 358/484; 385/116

(56) References Cited

U.S. PATENT DOCUMENTS 4,797,691 A * 1/1989 Akiyoshi et al. ..... 347/232
5,604,607 A * 2/1997 Mirzaoff ..... 358/484
5,930,433 A * 7/1999 Williamson et al. ..... 385/116
6,476,551 B1 * 11/2002 Osawa et al. ..... 313/506

FOREIGN PATENT DOCUMENTS

JP 10-76706 3/1998 ..... B41J/2/44

* cited by examiner

*Primary Examiner*—Hai Pham
(74) *Attorney, Agent, or Firm*—Sughrue Mion, PLLC

(57) ABSTRACT

A reflection case is attached to respective LEDs of an exposure head. An inner wall of the reflection case is formed with a first low-reflection area (reflectance is 0.1), a high-reflection area (reflectance is 0.9), and a second low-reflection area (reflectance is 0.1). These reflection areas are formed in an optical-axis direction from a side of the LED. The reflection case is disposed such that a middle point between the LED and a photosensitive surface of an instant film is positioned within the high-reflection area. The light emitted from the LED is reflected on the inner wall of the reflection case to be applied to the photosensitive surface of the instant film without dispersion. Owing to this, the effective exposure head may be produced.

16 Claims, 10 Drawing Sheets

EXPOSURE HEAD AND PRODUCING METHOD FOR A LIGHT GUIDING MEMBER THEREOF

BACKGROUND OF THE INVENTION

1. Field of the Invention

The present invention relates to an exposure head used for an instant printer and so forth.

2. Description of the Related Art

An instant printer built in an electronic still camera obtains a subject image by exposing an instant film with an exposure head utilizing a semiconductor light source of LEDs, a laser and so forth. Incidentally, the LEDs emit the light of red, green and blue. On the instant film, is recorded a subject obtained through a taking lens. In the case of the exposure head, the light emitted from the LED and the laser is condensed on the instant film by using a lens system of a condenser lens and so forth. Colors are controlled every dot. When the lens system is used for the exposure head, there arises a problem in that the exposure head becomes large. Further, in this instance, an amount of the light is reduced at the time of light transmission. Thus, there arises another problem in that it is required to secure sufficient exposure duration by slowing down a printing speed, in order to gain enough amounts of the light.

As to a method for solving the above problems, Japanese Patent Laid-Open Publication No. 10-76706 discloses a small-sized exposure head in which a condenser Lens is not used. This exposure head comprises a light-source portion, a front portion, and a light shielding portion. The front portion is formed with an opening for irradiating exposure light, which is emitted from a semiconductor light source, to a photosensitive material. The light shielding portion is formed with an opening for containing the semiconductor light source. The front portion is adapted to face the photosensitive material. By virtue of this, the light emitted from the light source is directly irradiated to a photosensitive surface of the photosensitive material. In this way, it is possible to form an image by using the high-intensity exposure light whose attenuation is small.

However, in the above-mentioned exposure head, the opening formed in the front portion is smaller than the opening formed in the light shielding portion. Due to this, there arises a problem in that the light emitted from the light source can not be efficiently used. As a method for solving this problem, it may be considered to employ a photosensitive material having high sensitivity. However, using the photosensitive material of high sensitivity causes an increase of cost. Meanwhile, since this exposure head does not use a lens system, a depth of focus is shallow. Thus, when a distance between the photosensitive material and the exposure head is long, there arises a problem in that contrast is lowered.

SUMMARY OF THE INVENTION

In view of the foregoing, it is a primary object of the present invention to provide an exposure head and a producing method therefor in which an amount of light emitted from a light source is efficiently used without using a lens system.

It is a second object of the present invention to provide an exposure head and a producing method therefor in which high-quality printing is performed by making a depth of focus deep.

In order to achieve the above and other objects, the exposure head according to the present invention comprises a plurality of light emitting elements and a light guiding member for surrounding each of these elements. The light emitting elements are disposed at same intervals to form an image on a photosensitive material. The light guiding member is attached to the light emitting element so as to surround an optical axis thereof. Light of the light emitting element is uniformly applied to a photosensitive surface of the photosensitive material by means of the light guiding member. At the same time, a part of the light of the light emitting element is reflected on an inner wall of the light guiding member. Owing to this, the lights of the adjacent light emitting elements are prevented from overlapping on the surface of the photosensitive material.

In a preferred embodiment, the inner wall of the light guiding member has at least two kinds of reflectance, namely low reflectance and high reflectance. A cross section of the light guiding member perpendicular to the optical axis is preferable to be a square shape or a circular shape. The inner wall of the light guiding member is constituted of a first low-reflection area, a high-reflection area, and a second low-reflection area. These areas are arranged from a side of the light emitting element toward the photosensitive material. The light guiding member is preferable to be disposed such that a middle point between the light emitting element and the photosensitive material is positioned within the high-reflection area.

In another embodiment, the inner wall of the light guiding member is slanted in an optical-axis direction thereof. The cross section of the light guiding member perpendicular to the optical axis is formed so as to become smaller gradually toward a light irradiation opening. In this instance, a slant angle $\theta$ of the inner wall is preferable to be within a range of $1° \leqq \theta \leqq 3°$. It is further effective that the inner wall of the light guiding member is formed from a material having the reflectance of 50% or more.

As to a producing method for the light guiding member whose inner wall is constituted of at least two kinds of reflectance, there is a method in which masking is performed for the low-reflection area of the light guiding member. Except a portion of masking, plating or deposition is carried out to form the high-reflection area.

According to the exposure head of the present invention, it is possible to obtain a large amount of the light without using a condenser lens. Moreover, the light of the light emitting element may be effectively used so that a picture print having high quality may be obtained without using a photosensitive material having high sensitivity. Further, it is possible to realize the exposure head in which the depth of focus is deep. Owing to this, positional management of the photosensitive material may be easily executed, and costs of the printer itself may be reduced.

BRIEF DESCRIPTION OF THE DRAWINGS

The above objects and advantages of the present invention will become apparent from the following detailed description of the preferred embodiments of the invention when read in conjunction with the accompanying drawings, in which.

DETAILED DESCRIPTION OF THE PREFERRED EMBODIMENT (S)

Figure 1:
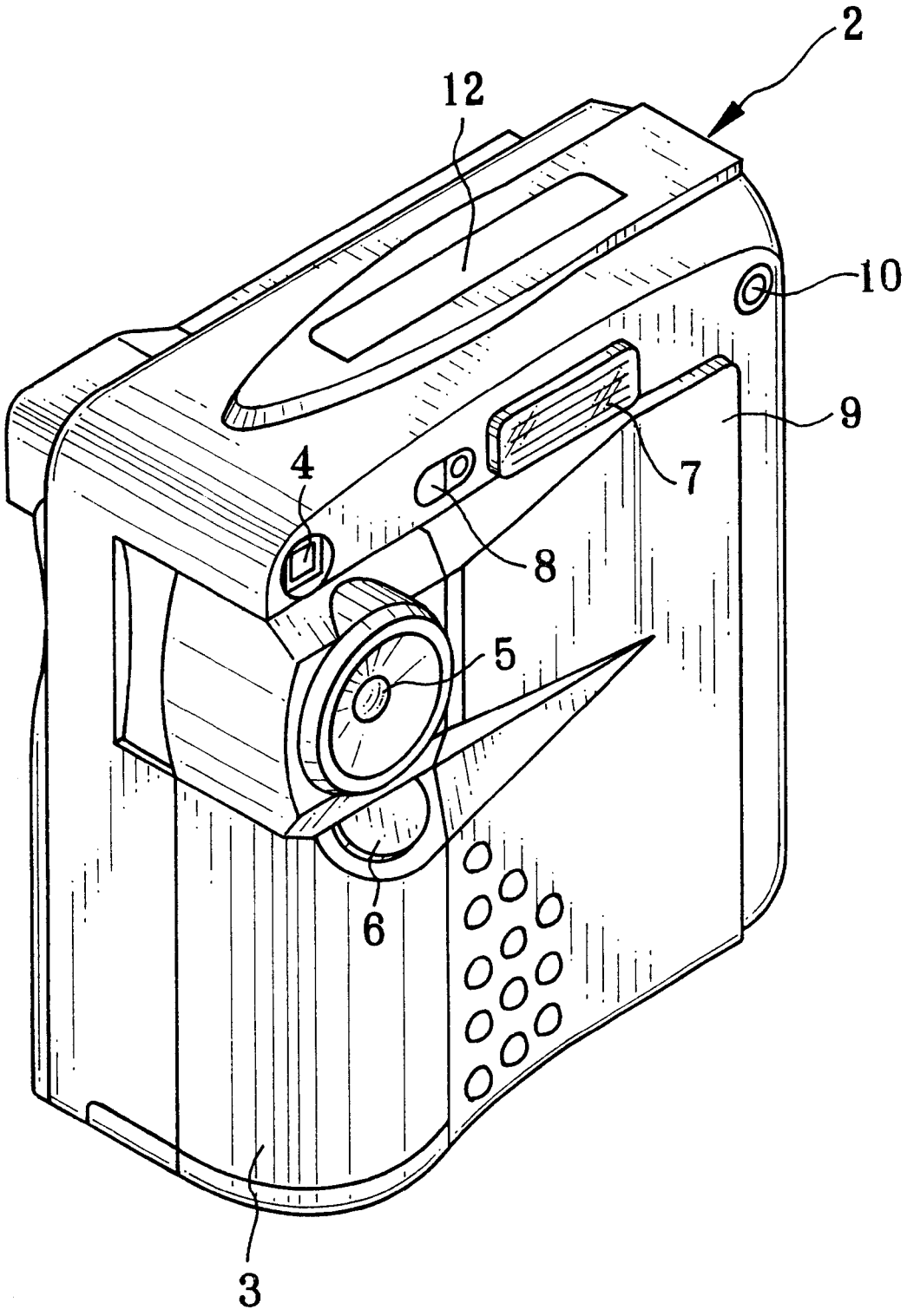
FIG. 1 is a perspective view showing a front side of an electronic still camera according to the present invention.

FIG. 1 is a perspective view showing a front side of an electronic still camera having a built-in instant printer according to the present invention. The electronic still camera 2 substantially has a parallelepiped shape. A front face of a camera body 3 is provided with a viewfinder window 4, a taking lens 5 having a zoom function, a release button 6, a flash window 7, and a light receiving window 8 for photometry. Moreover, a central portion of the camera body 3 is provided with a film-chamber lid 9. The camera body 3 is provided with a lock release button 10 disposed at a light-upper portion of the front face thereof. When a film pack is contained or is removed, the lock release button 10 is pressed to open the film-chamber lid 9. A top face of the camera body 3 is formed with a film outlet 11 (see FIG. 3) which is usually covered with an outlet lid 12.

Figure 2:
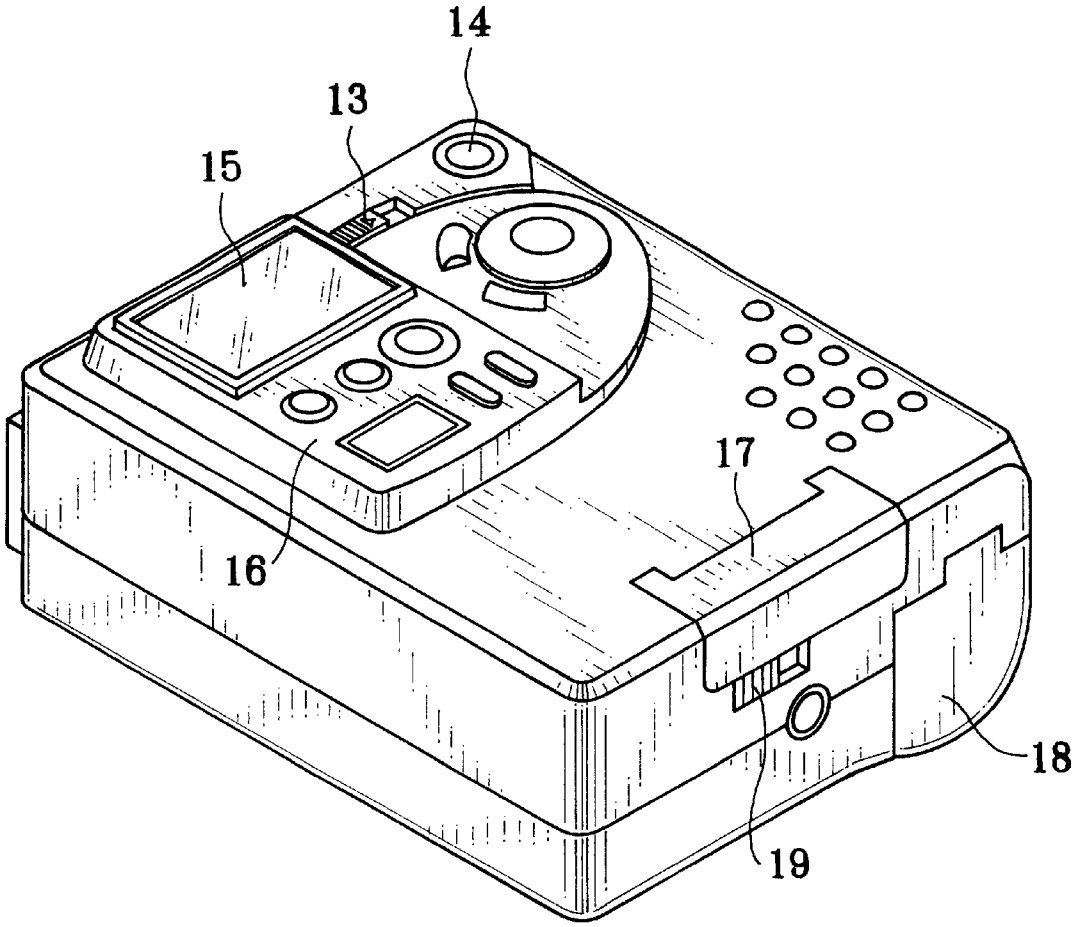
FIG. 2 is a perspective view showing a rear side of the electronic still camera.

As shown in FIG. 2, a rear face of the camera body 3 is provided with a power switch 13, an eyepiece window 14, a liquid-crystal-display panel (LCD panel) 15, and an operation panel 16. The LCD panel 15 displays, in real time, a subject image taken through the taking lens 5. In other words, the LCD panel 15 constitutes an electric viewfinder. The operation panel 16 includes a mode changing key, a frame selecting key, a print start key, an eraser key for image data, a data input-output key, and so forth. The mode changing key is for changing a photograph mode and a reproduction mode, and the data input-output key is for changing input and output of the image data. Moreover, a lower portion of the camera body 3 is provided with a memory-chamber lid 17 and a battery-chamber lid 18. The memory-chamber lid 17 is locked in a closed position. When a memory card is contained or is removed, the memory-chamber lid 17 is opened by moving a slider 19 provided on the bottom of the camera body 3.

Figure 3:
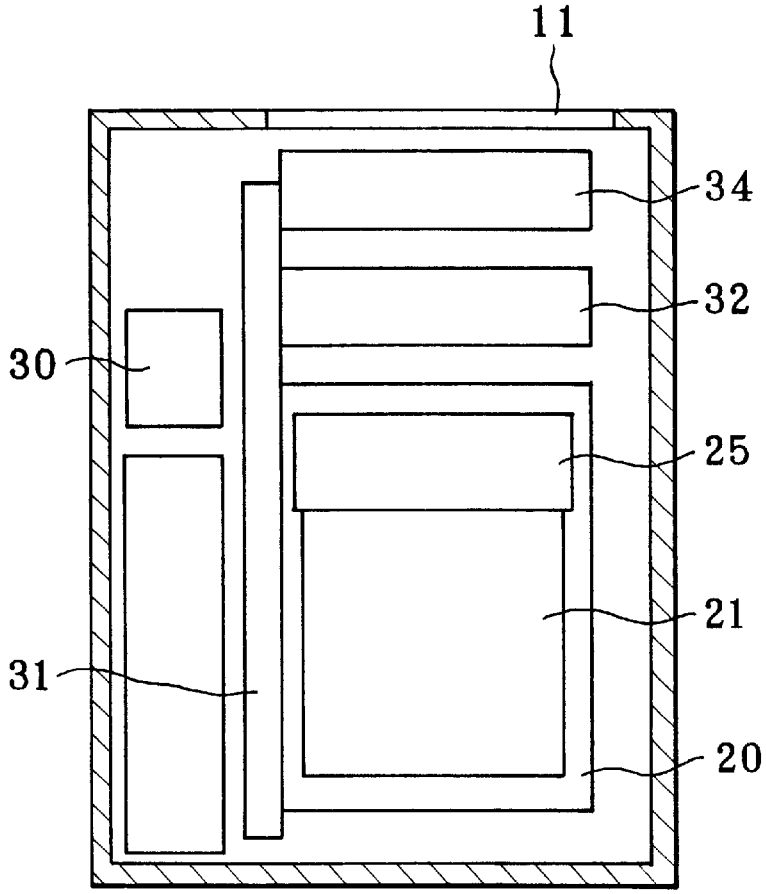
FIG. 3 is an explanatory illustration showing an internal structure of the electronic still camera.
Figure 4:
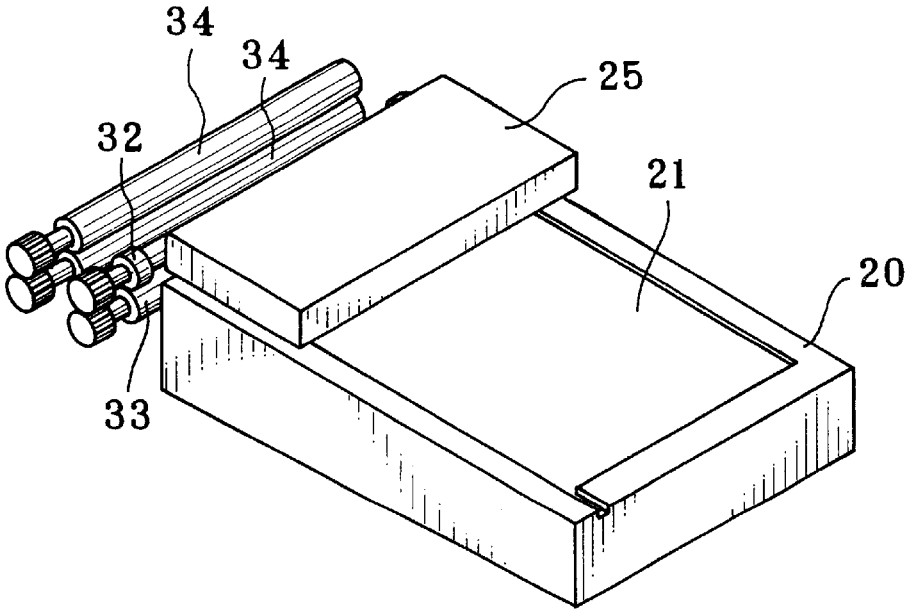
FIG. 4 is a perspective view showing a structure of a conveying mechanism of an instant film.

FIGS. 3 and 4 schematically show arrangement of components of the instant printer. After containing a film pack 20, the film-chamber lid 9 is closed. In association with this, an exposure head 25 is moved above the film pack 20 so as to be positioned just above an exposure aperture formed in the film pack 20. Upon instruction of printing, an instant film 21 is exposed with the exposure head 25.

A conveying mechanism for the instant film 21 is constituted of a DC motor 30, a driving mechanism 31, a capstan 32, a pinch roller 33, and a roller pair 34. The capstan 32, the pinch roller 33 and the roller pair 34 are rotated by the DC motor 30 via the driving mechanism 31. When the DC motor 30 is driven, a well-known claw (not shown) is actuated via the driving mechanism 31 to push the uppermost instant film 21. A top end of this instant film 21 is advanced to be interposed between the capstan 32 and the pinch roller 33. Successively, the advanced instant film 21 is conveyed by the above-mentioned components. After that, developer pods of the instant film 21 are broken by the roller pair 34 for permeation of the developer. The developed instant film 21 is discharged through the film outlet 11.

Figure 5:
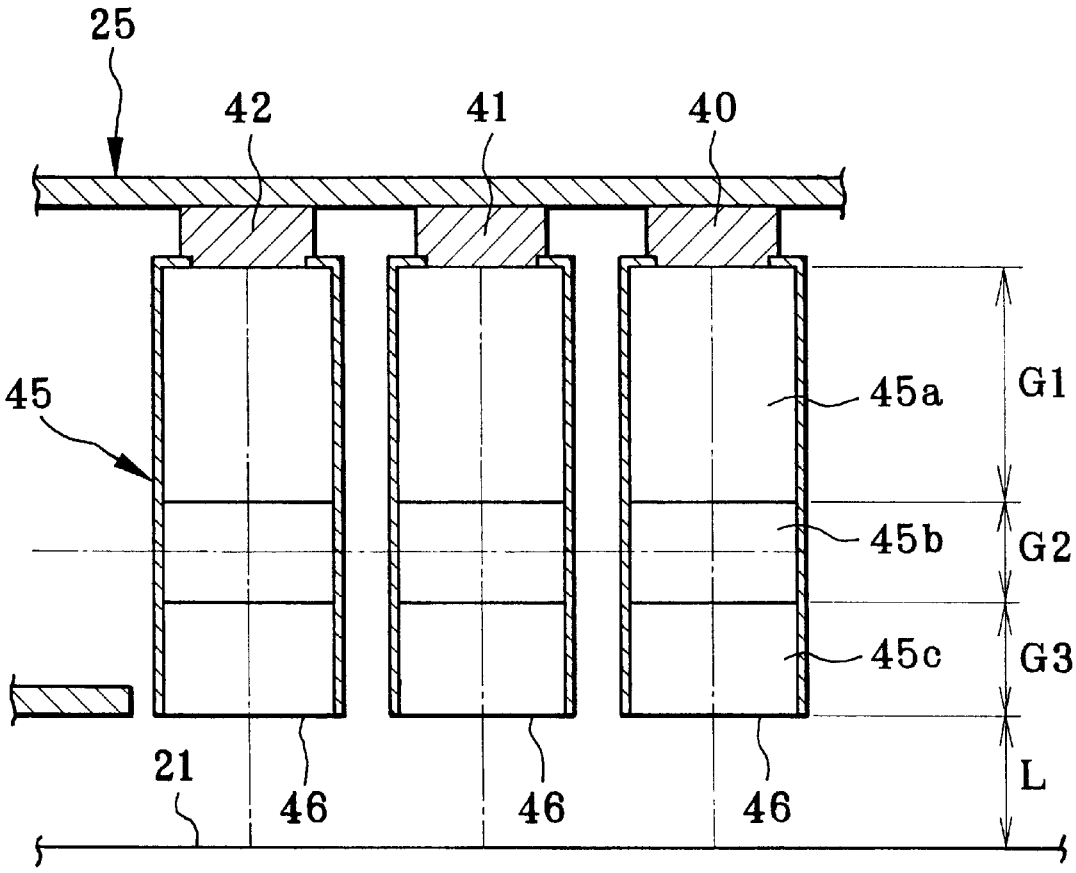
FIG. 5 is a sectional view showing a structure of an exposure head.

As shown in FIG. 5, the exposure head 25 comprises LEDs 40 to 42 respectively emitting light of each color of R, G and B. Each of the LEDs 40 to 42 has a line shape whose length corresponds to a width of an exposure area of the instant film 21. The respective LEDs 40 to 42 are disposed so as to lengthen in a main-scanning direction and are arranged in a sub-scanning direction in an order of R, G and B. It is possible to perform the exposure every dot. The respective LEDs 40 to 42 are controlled by a controller (not shown) with respect to a light emitting period and light intensity. Incidentally, the arrangement of the LEDs 40 to 42 is not exclusive to this embodiment. For example, the LEDs of R, G and B may be arranged in matrix (m×n). In this instance, the exposure head is required to be moved in the main-scanning direction at the time of printing.

A reflection case 45 is attached to the front of each of the LEDs 40 to 42. The reflection case 45 is used as a light guiding member and has a square cross section in a cross-wise direction relative to an optical axis of the reflection case 45. One end of the reflection case 45 is an opening facing a photosensitive surface of the instant film 21. In other words, one end of the reflection case 45 is an irradiation opening 46 through which the light emitted from the LED is applied to the instant film 21. The reflection cases 45 are arranged in matrix, and the adjacent reflection cases 45 are disposed at a predetermined interval. Incidentally, the cross section of the reflection case 45 is not exclusive to the square shape, but may be a circular shape.

Figure 6:
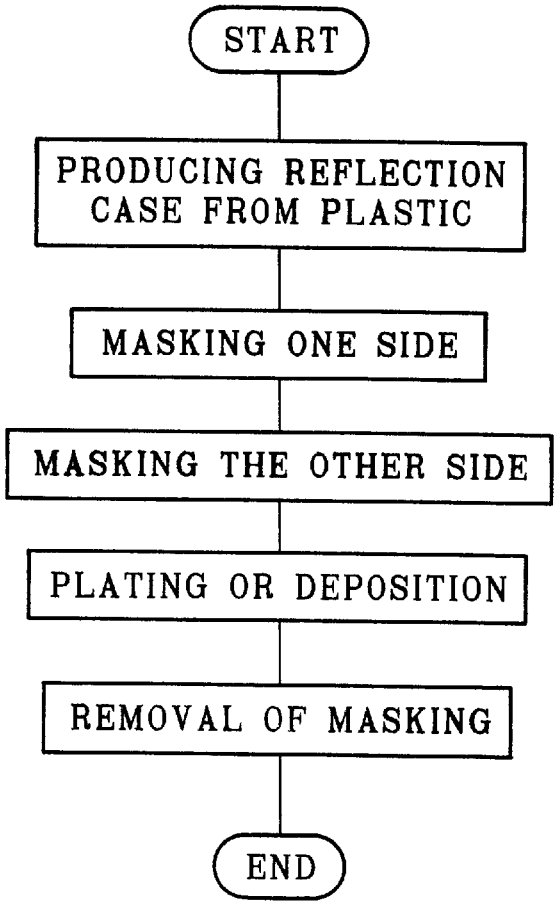
FIG. 6 is a flow chart showing a process for producing a reflection case.

A process for producing the reflection case 45 is described below, referring to a flow chart shown in FIG. 6. The reflection case 45 is formed from plastic which includes a black resin material comprising ABS resin, for example. One side of the reflection case 45 is dipped in a liquid masking material to perform masking. Similarly, masking is performed for the other side of the reflection case 45. After that, plating or deposition is carried out except the masking portion, using silver, aluminum, and so forth. Finally, the masking materials of both sides are removed. Incidentally, the reflection case 45 may be formed by means of micromachining and etching.

Figure 7:
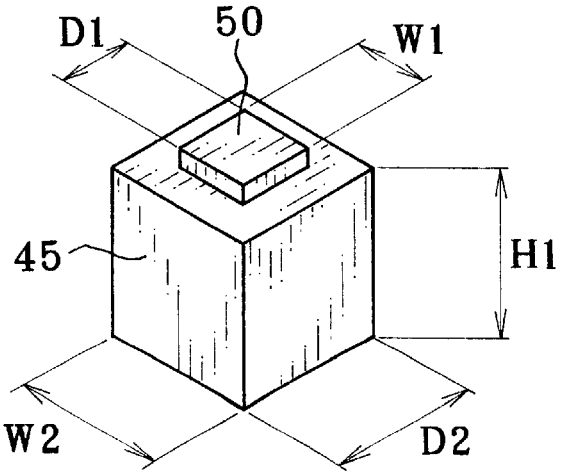
FIG. 7 is a perspective view showing an LED and the reflection case.
Figure 8:
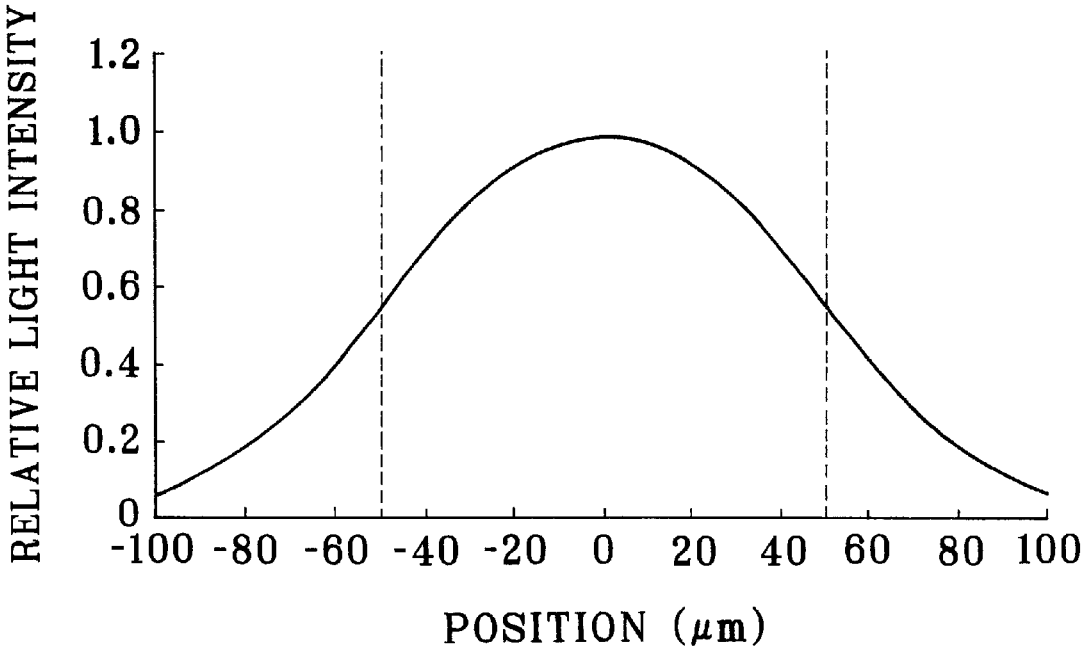
FIG. 8 is a graph showing a relationship between an irradiation range of the LED and light-amount distribution of respective positions when an inner wall of the reflection case is formed from only a high-reflection material.
Figure 9:
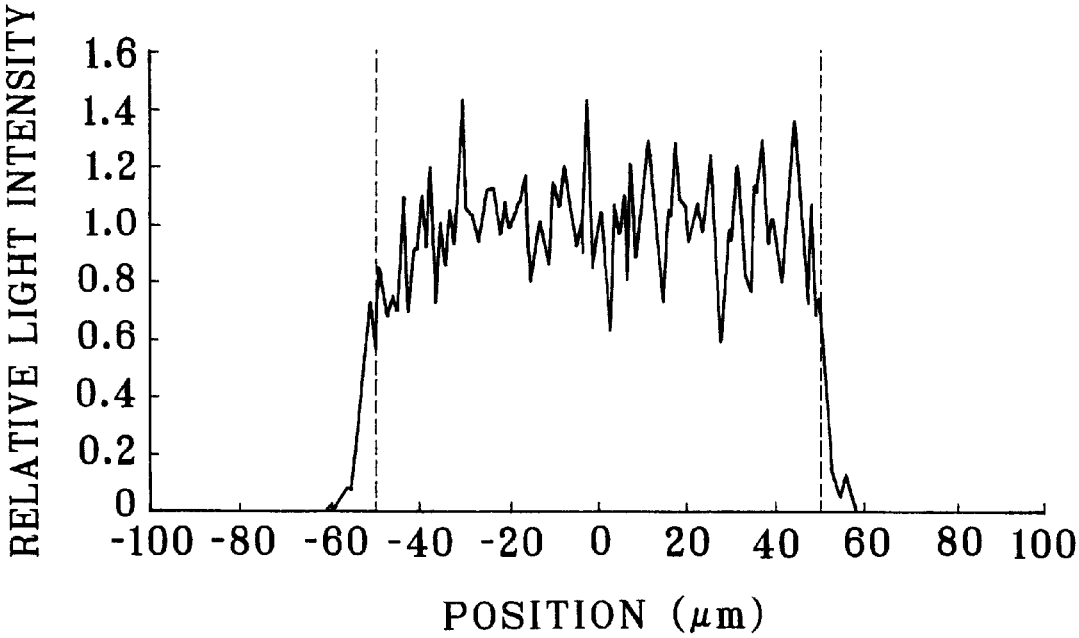
FIG. 9 is a graph showing a relationship between the irradiation range of the LED and light-amount distribution of the respective positions when the inner wall of the reflection case is formed from a low-reflection material and the high-reflection material.

FIG. 8 and FIG. 9 are graphs, each of which shows light-amount distribution of an area irradiated by the LED. Such as shown in FIG. 7, a size of the LED 50 (width W1×depth D1) is 80×80 μm, and a size of the reflection case 45 (width W2×depth D2×height H1) is 100×100×1000 μm. An abscissa line of the graph represents distances from an optical axis of the LED 50. An ordinate line of the graph represents relative light intensity with the proviso that the maximum amount of the light is set to 1. Meanwhile, in FIGS. 8 and 9, measurement is performed under a condition that a length L is 50 μm, wherein the length L is from the irradiation opening 46 of the reflection case 45 to the photosensitive surface of the instant film 21. When an inner wall of the reflection case 45 is formed only with a high-reflection area 45*b* (reflectance is 0.9, G1=G3=0, G2=1000 μm), the light-amount distribution becomes normal distribution, such as shown in FIG. 8. In this instance, since the width W2 of the reflection case 45 is equal to 100 μm, the light amount is considerably observed at the outside of dotted lines in FIG. 8. In other words, the light applied to the photosensitive surface considerably escapes so that contrast of an image is deteriorated.

When the inner wall of the reflection case 45 is formed with a first low-reflection area 45*a* (reflectance is 0.1, G1=510 m), the high-reflection area 45*b* (reflectance is 0.9, G2=40 μm), and a second reflection area 45*c* (reflectance is 0.1, G3=450 μm), the light is applied to the photosensitive surface of the instant film 21 within a range substantially corresponding to the width of the irradiation opening 46 of the reflection case 45. Thus, a leakage amount of the light is a little so that the contrast of the image is improved. Moreover, since the above-mentioned length L is set to 50 μm, a middle point between the respective LEDs 40 to 42 and the photosensitive surface of the instant film 21 is positioned within the high-reflection area 45*b*. Owing to this, it is possible to effectively use the light emitted from the LED. Further, by using the reflection case 45, it is possible to make the interval of the adjacent LEDs narrower than the height of the reflection case 45.

By the way, the breadths G1 to G3 of the reflection areas 45*a* to 45*c* are different in accordance with the size and the light amount of the LED, the size of the reflection case, the reflectance of the reflection area, and the length between the irradiation opening of the reflection case and the photosensitive surface of the instant film. The breadths G1 to G3 may be properly changed in accordance with a size of the exposure head. Meanwhile, the reflectance of the first low-reflection area 45*a* is determined so as to be same with that of the second low-reflection area 45*c*. However, this is not exclusive. The reflectance maybe properly changed.

Figure 10:
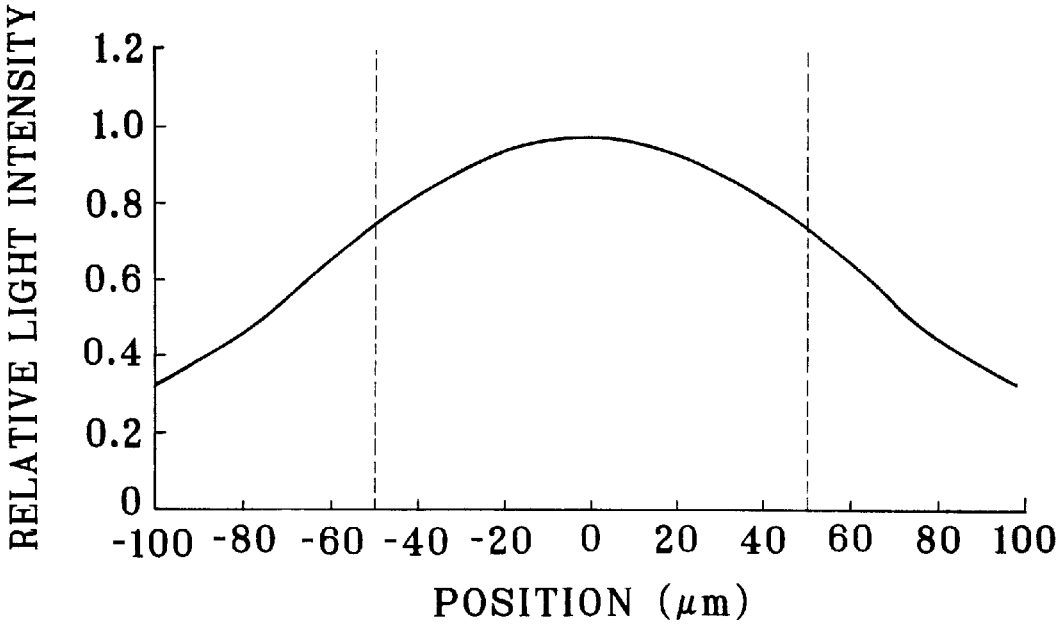
FIG. 10 is a graph showing another example of a relationship between the irradiation range and the light-amount distribution when the inner wall of the reflection case is formed from only the high-reflection material.
Figure 11:
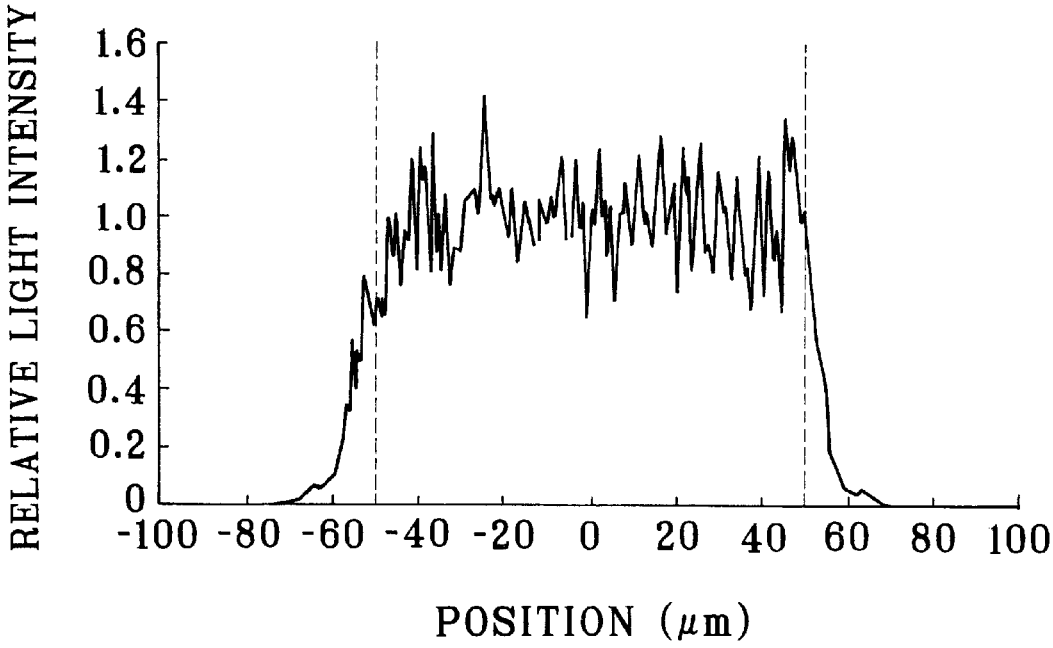
FIG. 11 is a graph showing another example of a relationship between the irradiation range and the light-amount distribution when the inner wall of the reflection case is formed from the low-reflection material and the high-reflection material.

In the above embodiment, the reflection case 45 is disposed such that the middle point between the respective LEDs 40 to 42 and the photosensitive surface of the instant film 21 is positioned within the high-reflection area 45*b*. The middle point, however, may be positioned at a border between the high-reflection area and the low-reflection area. For example, when the sizes of the LED and the reflection case are identical with that of the above embodiment and the length L is set to be equal to 100 μm, the light-amount distribution of the area irradiated by the LED is shown in each of FIGS. 10 and 11. As shown in these drawings, when the inner wall of the reflection case 45 is formed only with the high-reflection area 45*b*, the light-amount distribution becomes normal distribution. At this time, a spread of distribution is wider in comparison with the case of 50 μm. Due to this, the leakage amount of the light becomes larger so that the contrast is deteriorated. In the meantime, when the inner wall is constituted of three reflection areas, the irradiation range and the contrast do not change in comparison with the case in that the length L is equal to 50 μm.

Figure 12:
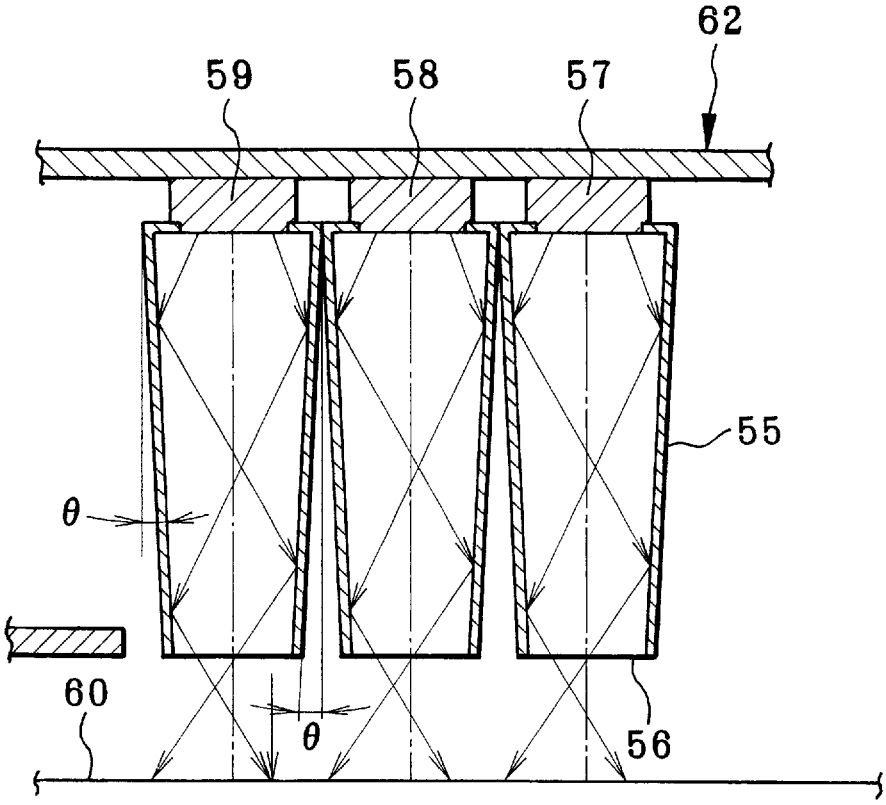
FIG. 12 is a sectional view showing a structure of the exposure head in a case that the inner wall of the reflection case is slanted in an optical-axis direction.

As to another method in which the light emitted from a plurality of elements disposed at same intervals is uniformly applied to the photosensitive material and the light of the adjacent elements are prevented from overlapping, it is considered that the inner wall of the reflection case is slanted in an optical-axis direction. In this instance, as shown in FIG. 12, the inner wall of the reflection case 55 is inwardly slanted by θ relative to the optical axis. In other words, the reflection case 55 is formed such that a section thereof crosswise to the optical axis is adapted to gradually become small from an LED side toward an irradiation opening 56. The section of the reflection case 55 may have a circular shape instead of the square shape. In this instance, the inner wall of the reflection case 55 (including a side inner wall and an end inner wall to which the LEDs 57 to 59 are attached) is formed from a material having the high reflectance. The light emitted from each of the LEDs 57 to 59 is reflected inside the reflection case 55 and is applied to a photosensitive surface of the instant film 60 through the irradiation opening 56 which is formed at a position facing the instant film 60. Incidentally, reference numeral 62 denotes the exposure head.

Figure 13:
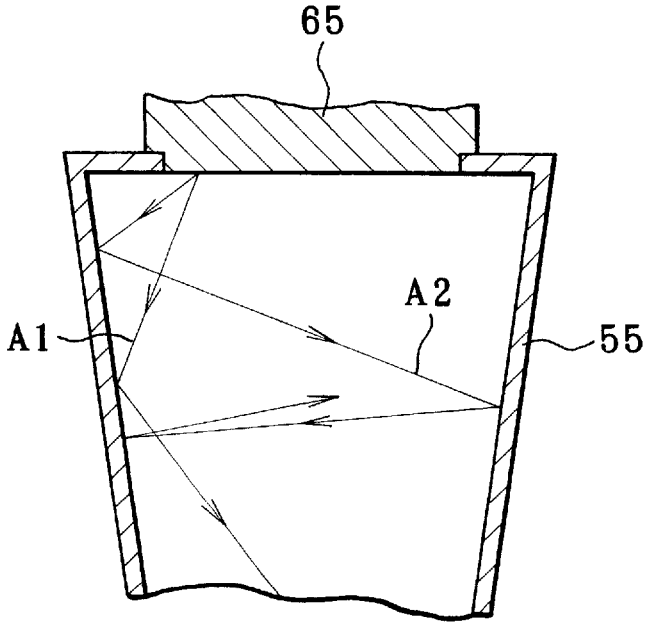
FIG. 13 is a sectional view showing a reflection state of the light emitted from the LED.

In FIG. 13, light A1 is emitted from an LED 65 so as to have an angle which is near a right angle relative to the photosensitive material. The light A1 is reflected on the inner wall of the reflection case and is applied to the photosensitive surface of the photosensitive material through the irradiation opening 56. In contrast, light A2 is emitted so as to have an angle which is near a parallel angle relative to the photosensitive material. The light A2 is repeatedly reflected on the inner wall of the reflection case 55 and is not applied to the photosensitive material. Owing to this, the reflected light of the respective LEDs 57 to 59 may be effectively used. Incidentally, the material of the inner wall of the reflection case 55 is sufficient to have the reflectance of 50% or more. Instead of forming the inner wall of the reflection case 55 from the material having the high reflectance, plating and deposition using silver, aluminum, and so forth may be performed for the inner wall of the reflection case 55.

Figure 14:
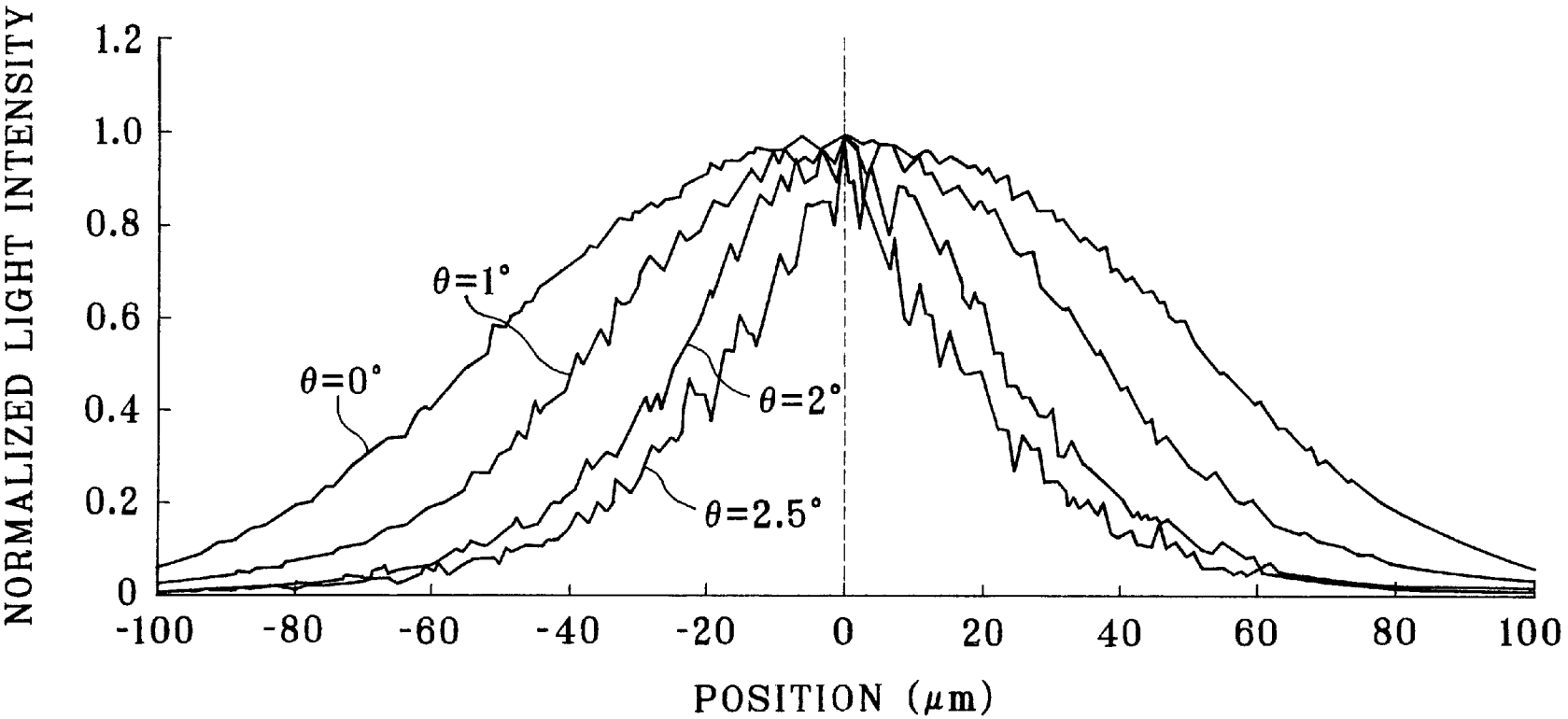
FIG. 14 is a graph showing the light-amount distribution under a condition that the inner wall of the reflection case is slanted.
Figure 15:
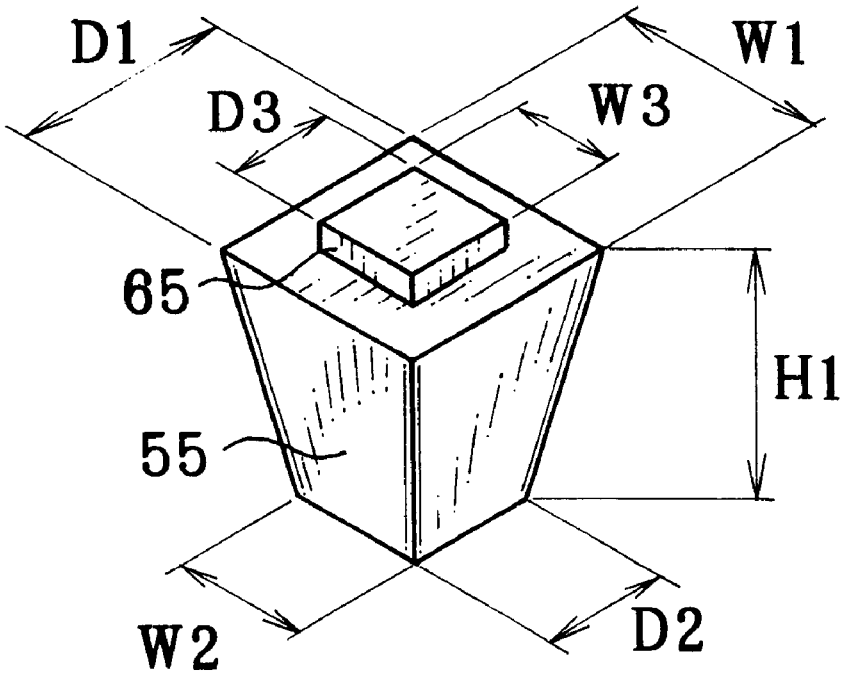
FIG. 15 is a perspective view showing the LED and the reflection case.

FIG. 14 is a graph showing examples of the light-amount distribution on the photosensitive surface under a condition that the slant angle θ of the reflection case 55 is changed. An abscissa line of the graph has the origin which coincides with the optical axis of the LED. An ordinate line of the graph represents the normalized light intensity of each position under a condition that the maximum light amount is set to 1. As shown in FIG. 15, the reflection case used in this embodiment has an upper face whose sizes (width W1×depth D1, and height H1) are respectively 100×100 μm, and 1000 μm. Meanwhile, the LED 65 has sizes (width W3×depth D3) are 80×80 μm. The irradiation opening 56 of the reflection case 55 has sizes (width W2×depth D2) which are determined in accordance with the slant angle θ. The slant angles θ are set to four kinds of 0°, 1°, 2° and 2.5°, and the graph in FIG. 14 shows the light-amount distribution of each condition.

When the slant angle θ is 0°, the reflection case 55 has a parallelepiped shape. In this instance, such as shown in FIG. 14, the light emitted from the LED 65 becomes normal distribution wherein a dispersion width is long on the photosensitive surface of the photosensitive material. As the slant angles θ are set to 1°, 2° and 2.5°, the dispersion width of the light applied to the photosensitive surface becomes shorter. In other words, a percentage of the applied light becomes large around an intersection of the photosensitive surface and the optical axis of the LED 65. The light intensity is rapidly lowered in accordance with a separation from the intersection so that the leakage light may be reduced. In view of this, the inner wall of the reflection case 55 is preferable to be formed within a range of the slant angle θ being $1° \leqq \theta \leqq 3°$, more preferably, $1° \leqq \theta \leqq 2.5°$. By slanting the inner wall of the reflection case 55 within the above range, is effectively used the irradiation light of the LED 65 advancing at an angle being substantially perpendicular to the photosensitive material. The light emitted from the LED 65 at a small angle relative to the photosensitive material is cut out so that a percentage of the leakage light is reduced. Consequently, the contrast between the adjacent pixels may be intensified.

In the above embodiment, the present invention is adopted to the exposure head of the instant printer. The present invention, however, may be adopted to an exposure head of a printer using a peculiar photosensitive material, such as disclosed in Japanese Patent Laid-Open Publication No. 10-76706.

Although the present invention has been fully described by way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. An exposure head for exposing a photosensitive material to record an image, comprising:

a plurality of light emitting elements disposed in a first direction at common intervals, said light emitting elements recording one line extending in said first direction on said photosensitive material, and one of said exposure head and said photosensitive material being moved in a second direction perpendicular to said first direction to record said image on said photosensitive material one line by one line; and each of said light emitting elements including a light emitting surface and a corresponding light guiding member attached to said light emitting surface each of said light guiding members comprising a tube-shaped case so as to surround an optical axis of a corresponding one of said light emitting elements, and a light emitted from said corresponding light emitting element being guided to said photosensitive material as a part of said light is reflected on an inner wall of said corresponding light guiding member.

2. An exposure head according to claim 1, wherein said inner wall of each of said light guiding members is constituted of at least two kinds of a low-reflection area and a high-reflection area which are arranged in a direction of said optical axis.

3. An exposure head according to claim 2, wherein a cross section of each of said light guiding members being perpendicular to said optical axis has one of a square shape and a circular shape.

4. An exposure head according to claim 3, wherein said inner wall of each of said light guiding members is constituted of a first low-reflection area, a high-reflection area, and a second low-reflection area arranged in order from a side of said corresponding light emitting element toward said photosensitive material, and a middle point between said corresponding light emitting element and said photosensitive material is positioned within said high-reflection area.

5. An exposure head according to claim 4, wherein said first and second reflection areas have same reflectance.

6. An exposure head according to claim 1, wherein said inner wall of each of said light guiding members is slanted in a direction of said optical axis such that a cross section of said light guiding member being perpendicular to said optical axis continuously becomes small from a side of said light emitting element toward said photosensitive material.

7. An exposure head according to claim 6, wherein a slant angle of said inner wall relative to said optical axis is 1° or more and is 3° or less.

8. An exposure head according to claim 7, wherein said inner wall is formed from a material having reflectance of 50% or more.

9. An exposure head according to claim 7, wherein one of plating and deposition is performed for said inner wall.

10. An exposure head according to claim 9, wherein silver and aluminum are used when said plating and said deposition are performed.

11. An exposure head according to claim 7, wherein said cross section of each of said light guiding members has one of a square shape and a circular shape.

12. A producing method for a light guiding member used for an exposure head which exposes a photosensitive material to record an image, said light guiding member being attached to a light emitting element of said exposure head, and an inner wall of said light guiding member conducting a light of said light emitting element toward said photosensitive material as said light is reflected, said producing method for said light guiding member comprising the steps of:

carrying out masking for a part of said light guiding member;

carrying out one of plating and deposition except a masking portion to form a high-reflection area; and carrying out removal of masking, said masking portion being formed with a low-reflection area.

13. A producing method for a light guiding member according to claim 12, wherein said light guiding member is formed from a plastic using a black resin.

14. A producing method for a light guiding member according to claim 13, wherein silver and aluminum are used when said plating and said deposition are carried out.

15. A producing method for a light guiding member according to claim 14, wherein said high-reflection area is formed at a central portion of said inner wall of said light guiding member in an optical-axis direction, both sides of said high-reflection area are respectively formed with said low-reflection area.

16. An exposure head for exposing a photosensitive material to record an image, comprising:

a plurality of light emitting elements disposed in a first direction at the same intervals, said light emitting elements recording one line extending in said first direction on said photosensitive material, and one of said exposure head and said photosensitive material being moved in a second direction perpendicular to said first direction to record said image on said photosensitive material one line by one line; and a light guiding member attached to a light emitting surface of at least one of said light emitting elements, said light guiding member having a tube shape so as to surround an optical axis of said at least one of said light emitting elements, and a light emitted from said at least one of said light emitting elements being guided to said photosensitive material as a part of said light is reflected on an inner wall of said light guiding member, wherein said inner wall of said light guiding member is constituted of at least two kinds of a low-reflection area and a high-reflection area which are arranged in a direction of said optical axis.

* * * * *